US008156676B1

(12) United States Patent
Moody

(10) Patent No.: US 8,156,676 B1
(45) Date of Patent: Apr. 17, 2012

(54) INTEGRAL WEAPON RAPID DEPLOYMENT MONOPOD

(76) Inventor: Joseph R. Moody, Jacksonville, FL (US)

( * ) Notice: Subject to any disclaimer, the term of this patent is extended or adjusted under 35 U.S.C. 154(b) by 173 days.

(21) Appl. No.: 12/635,885

(22) Filed: Dec. 11, 2009

(51) Int. Cl.
*F41C 23/00* (2006.01)

(52) U.S. Cl. ..... 42/71.01

(58) Field of Classification Search ..... 42/71.01, 42/72, 73, 94
See application file for complete search history.

(56) References Cited

U.S. PATENT DOCUMENTS

| | | | | |
|---|---|---|---|---|
| 271,251 | A | 1/1883 | Leerbech | |
| 575,529 | A | 1/1897 | Stephens | |
| 579,529 | A | 3/1897 | Stephens | |
| 583,656 | A | 6/1897 | McGrady | |
| 713,114 | A | 11/1902 | Force | |
| 721,425 | A | 2/1903 | Clyde | |
| 944,646 | A | 12/1909 | Xardell | |
| 1,295,688 | A | 2/1919 | Butler | |
| 1,355,660 | A | 2/1920 | Farquhar | |
| 1,382,409 | A | 6/1921 | Butler | |
| 1,580,406 | A | 4/1926 | Browning | |
| 2,008,964 | A | 7/1935 | Mikulic | |
| 2,386,802 | A | 10/1945 | Johnson | |
| 2,420,267 | A | 5/1947 | Sefried | |
| 2,436,349 | A | 2/1948 | Adams | |
| 2,472,804 | A | 6/1949 | Bird | |
| 2,489,283 | A | 11/1949 | Garand | |
| 2,763,456 | A | 9/1956 | Breer | |
| 2,807,904 | A | 10/1957 | Kreske | |
| 2,844,905 | A | 7/1958 | Musser | |
| 2,898,137 | A | 8/1959 | Kreske | |
| 2,991,579 | A | 7/1961 | Lies | |
| 3,235,997 | A | 2/1966 | Stoner | |
| 3,385,164 | A | 5/1968 | Waither | |
| 3,632,073 | A | 1/1972 | Nakatani | |
| 3,683,535 | A | 8/1972 | Lewis | |
| 4,121,799 | A | 10/1978 | Michio | |
| 4,291,610 | A | 9/1981 | Waiser | |
| 4,545,660 | A | 10/1985 | Rudolf | |
| 4,575,964 | A * | 3/1986 | Griffin | 42/94 |
| 4,576,083 | A | 3/1986 | Seberger | |
| 4,588,043 | A | 5/1986 | Finn | |
| 4,907,488 | A | 3/1990 | Seberger | |
| 4,974,489 | A | 12/1990 | Fishbaugh | |
| 5,164,535 | A | 11/1992 | Leasure | |
| 5,345,706 | A | 9/1994 | Brown | |
| 5,384,609 | A | 1/1995 | Ogawa | |
| 5,438,786 | A | 8/1995 | Hiderbrand | |
| 5,679,916 | A | 10/1997 | Weichert | |
| 6,305,116 | B1 | 10/2001 | Parker | |
| 6,374,718 | B1 | 4/2002 | Rescigno | |
| 6,487,807 | B1 | 12/2002 | Kopman | |
| 6,536,152 | B1 | 3/2003 | Wisz | |

(Continued)

*Primary Examiner* — Bret Hayes
*Assistant Examiner* — Reginald Tillman, Jr.
(74) *Attorney, Agent, or Firm* — Brian S. Steinberger; Law Offices of Brian S. Steinberger, P.A.

(57) ABSTRACT

Devices, apparatus, systems and methods of using a rear pistol handle on a rifle with a rapidly extendable and height adjustable monopod for enhancing stability and shot accuracy, where the monopod is retracted and concealed inside the rear grip handle when not used, and supports and stabilizes the firearm when the monopod is extended. A spring biased button can be depressed to allow for springs on top of retracted telescoping cylinders to spread apart and extend out from beneath a grip handle on the rifle. The invention can be used to create a triangulation configuration effect when used with a forward bipod, such as a forward grip bipod.

11 Claims, 17 Drawing Sheets

U.S. PATENT DOCUMENTS

| | | | | |
|---|---|---|---|---|
| 7,111,424 | B1 | 9/2006 | Moody | |
| 7,124,528 | B2 | 10/2006 | Long | |
| D566,219 | S | 4/2008 | Moody | |
| D566,220 | S | 4/2008 | Moody | |
| 7,421,815 | B1 | 9/2008 | Moody | |
| 7,490,429 | B2 | 2/2009 | Moody | |
| 7,610,711 | B2 * | 11/2009 | Oz | 42/94 |
| 7,845,602 | B1 * | 12/2010 | Young et al. | 248/125.8 |
| 2002/0040544 | A1 | 4/2002 | Muhlestein | |
| 2005/0241206 | A1 | 11/2005 | Teetzel | |

* cited by examiner

INTEGRAL WEAPON RAPID DEPLOYMENT MONOPOD

The present invention relates to firearms including rifles and more particularly to devices, apparatus, systems and methods of using a rear pistol handle on a rifle with a rapidly extendable and height adjustable monopod for enhancing stability and shot accuracy, where the monopod is retracted and concealed inside the rear grip handle when not used, and supports and stabilizes the firearm when the monopod is extended.

BACKGROUND AND PRIOR ART

Stabilizing a firearm such as a rifle over a surface such as the ground is desirable to improve reduce movement of the firearm and improve accuracy of the shots. Current automatic firearm rifles have an existing rear pistol type grip that is difficult to lay on top of the ground surface since it causes the gun to be held to an uncomfortable and undesirable position close to the ground.

U.S. Pat. No. 7,124,528 to Long describes a "Firearm Pistol Grip Monopod Gun Stabilizer", title, that uses an adjustable pistol grip monopod, that can be used with a rifle. However, this device is limited to a threaded rod which must be manually rotated and to slowly become extended beneath the pistol grip. This slow and tedious operation is not suitable for combat or hunting applications were split second timing is necessary to make shots. In addition this device requires the user manually reverse the rotation in order to slowly retract the threaded rod back into the grip, which would also be time consuming an tedious to the user.

Still furthermore, the Long '528 device does not allow for consistent height adjustments since the threaded rod must be separately rotated and adjusted each time it is used. Thus, the user does not have consistent uniform height adjustments when the device is reused overtime. Without the consistent height adjustment levels, the user cannot accurately be trained overtime since each height adjustment use when less than the fully extended position results in a different height level.

Additionally, the solid threaded metal rod adds unnecessary weight, and having a small diameter is not strong. Users in the field do not find it desirable to add more weight to their equipment that must be hand carried from place to place. The narrow diameter of the rod may allow it to bend, and also does not allow for a stable platform on which to sit the rife type firearm. Still furthermore, the foot pad used with this device has both a small foot print that does not provide a stable support, and also has a flat surface which can slide on a like smooth surface, which would also effect the shot accuracy over time.

Other devices have also been attempted to be used with the rear grips on rifles, but also have similar problems to the Long '528 device. See for example, U.S. Pat. No. 2,884,905 to Musser et al.; U.S. Pat. No. 3,683,535 to Lewis; U.S. Pat. No. 6,305,116 to Parker; U.S. Pat. No. 6,536,152 to Wisz, and U.S. Patent Application Publication 2002/0040544 to Muhlestein.

Thus, the need exists for solutions to the problems with the prior art.

SUMMARY OF THE INVENTION

A primary objective of the subject invention is to provide devices, apparatus, systems and methods of using a rear pistol grip for a firearm with a rapidly deployable monopod for enhancing firearm stability and shot accuracy.

A secondary objective of the subject invention is to provide devices, apparatus, systems and methods of using a rear pistol grip for a firearm with a rapidly deployable monopod that can quickly retract and become concealed within the rear pistol grip.

A third objective of the subject invention is to provide devices, apparatus, systems and methods of a new rear grip or rear gun handle with an easily deployable monopod that helps to stabilize the gun when fired.

A fourth objective of the subject invention is to provide devices, apparatus, systems and methods of quickly adjusting selective height adjustments to a deployable monopod on a rear pistol grip where the height adjustments are selective and repeatable overtime.

A fifth objective of the subject invention is to provide devices, apparatus, systems and methods of using a rear pistol grip handle with a deployable monopod that is able to quickly grip the surface upon which it is deployed without sliding about the surface.

A sixth objective of the subject invention is to provide devices, apparatus, systems and methods of using a rear pistol grip handle with an extendable and retractable monopod that is both strong, lightweight, and fast to deploy and retract.

The present invention comprises a monopod mounting assembly that can be self-contained in a rear pistol grip that can be substituted for existing rear pistol grips on firearms, such as automatic rifles and the like.

A preferred embodiment of the rear firearm grip with deployable monopod, can include an elongated grip handle having an upper end and a lower end and a channel opening through the handle, a mount member for attaching the upper end of the grip handle as a rear pistol grip on a firearm, a telescoping assembly inside of the handle having a retracted position with the telescoping assembly within the handle, and an extended position with the telescoping assembly extended from underneath the lower end of the handle forming a monopod, and a switch on the handle for automatically moving the telescoping assembly from the retracted position to the extended position.

a spring member can be included for causing the telescoping assembly to rapidly move from the retracted position to the extended position when the switch is activated.

The telescoping assembly can be two cylinders which slide relative to one another. A spring member can cause the telescoping assembly to rapidly move from the retracted position to the extended position when the switch is activated.

Interchangeable foot pads can completely covers the lower end of the grip handle.

The switch for causing the extension of the cylinders can be a depressible button, and can include a spring for biasing the button in an extended position. An adjustment control can be used for selecting different extendable heights of the monopod.

A preferred method of rapidly deploying a monopod from a rear pistol grip on a firearm, can include the steps of providing a rifle, providing a rear pistol grip housing having an opening therethrough, attaching an upper end of the rear pistol grip to a rifle, providing a monopod having an upper end and a lower end, the monopod having a retracted position within the opening of the grip housing, and an expanded position with the lower end of the monopod extended below the grip housing, compressing a spring with the upper end of the monopod when the monopod is in the retracted position, and releasing the spring to rapidly deploy the monopod to the extended position.

The method can include telescoping cylinders that slide within one another and within the grip housing, and a side depressible button on the housing; steps for rapidly and automatically expanding the telescoping cylinders from the retracted position to the extended position by actuating the depressible button.

The method can include locking the telescoping cylinders to different extended lengths with the actuating of the button, steps for interchanging different sized footers on the bottom of the monopod to support the monopod over different terrain surfaces.

The method can further include the steps of attaching a vertical forgrip having a deployable bipod under a front portion of the rifle, and forming a triangulation configuration for operating the rifle with the extended monopod and the forward grip deployed into a bipod.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
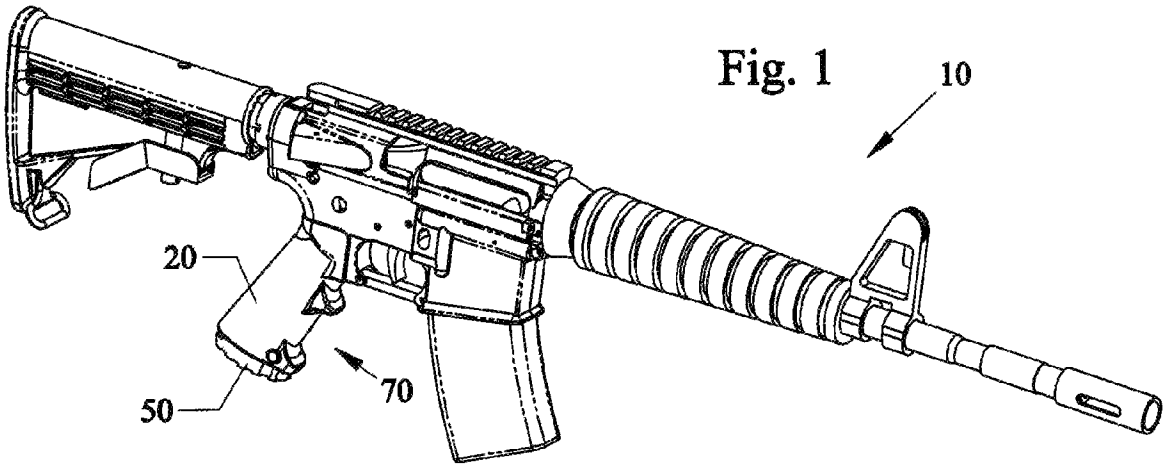
FIG. 1 is a perspective side view of an assault rifle with an installed monopod grip assembly with the monopod retracted.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

The components will now be described.

5 Clip edge on top of grip assembly
10 Assault rifle.
20 Monopod assembly.
30 Telescoping insert #1 (Upper Telescoping Cylinder).
32 Top of cylinder
40 Telescoping insert #2 (Lower Telescoping Cylinder).
43 slot through top of lower cylinder
49 side protruding edges on bottom of lower cylinder 40
50 Interchangeable foot slides onto insert #2 (lower cylinder 40)
52 side edge
53, groove
56 raised edges in convex curved arc configuration under foot
58 side edge
59 groove
60 Actuator button
70 Monopod grip.
72, 74 Raised gripping protrusions
76 Bottom of upper ledge of grip housing
80 Locking spring for telescoping insert #2 (lower telescoping cylinder 40).
88 Bottom of locking spring
90 Mounting screw for locking spring.
100 Slots cut into telescoping insert #1 engage actuator button to allow adjustment of the inserts extension.
100L lowest slot

110 Single slot cut into telescoping insert #2 engages actuator button when insert is fully retracted and locks the insert into the retracted position.

120 Catch on locking spring engages slot in insert #1 to lock the insert into the fully extended position. Inserts #1 & #2 are locked together when #1 is extended.

130 Slot cut into insert #1 for locking spring engagement.

140 Actuator button return spring.

142 locking tab

143 step on locking tab

150 Cover for spring cavity in monopod grip.

160 Telescoping insert #1 extension spring.

170 Telescoping insert #2 extension spring.

180 Ramp on locking spring 80 engages inside edge of monopod grip when the inserts are pushed into the grip. When the ramp engages the inside edge of the grip it flexes the locking spring and disengages the catch on the spring from the slot in insert #2 which allows insert #2 to fully retract.

190 Slot cut into insert #1 for the ramp on the locking spring.

200 Guide pin for insert #1 extension spring is molded into monopod grip.

210 Guide pin for insert #2 extension spring is a part of insert #1.

220 Cavity in insert #2 is to contain compressed #2 extension spring.

230 Locking tab on actuator button engages slots in inserts to lock them into position. Insert #1 can be locked into multiple positions to facilitate adjustment of the telescoping assemblies length. Insert #2 can only be locked in the fully retracted (up) position with the actuator button.

240 Snap rings on the ends of both insert #1 & insert #2 guide pins stop the motion of the inserts when they are extended.

300 Forward grip bipod

Figure 2:
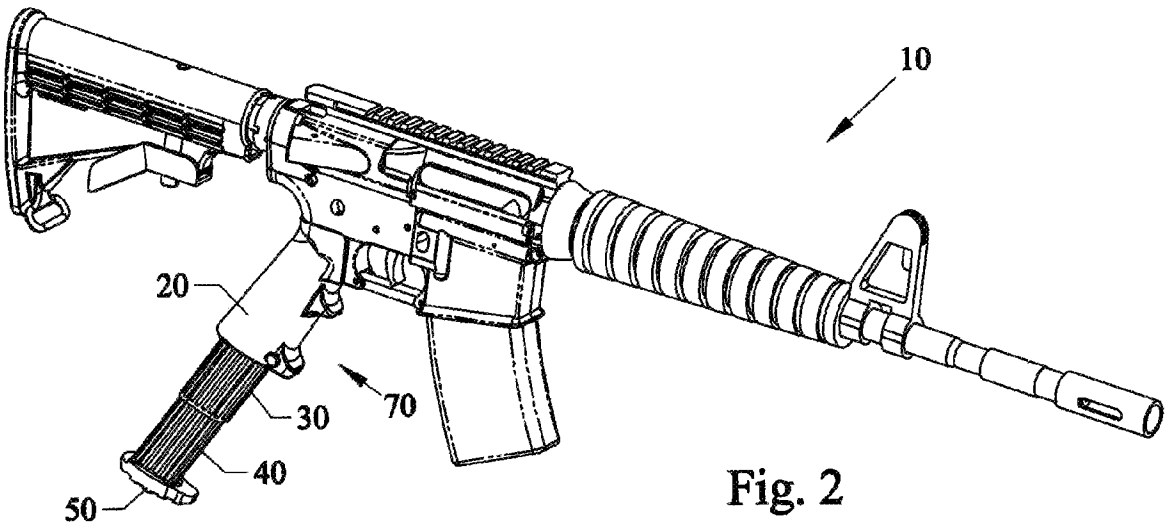
FIG. 2 is a perspective view of assault rifle with monopod grip assembly of FIG. 1 with monopod fully extended.
Figure 3:
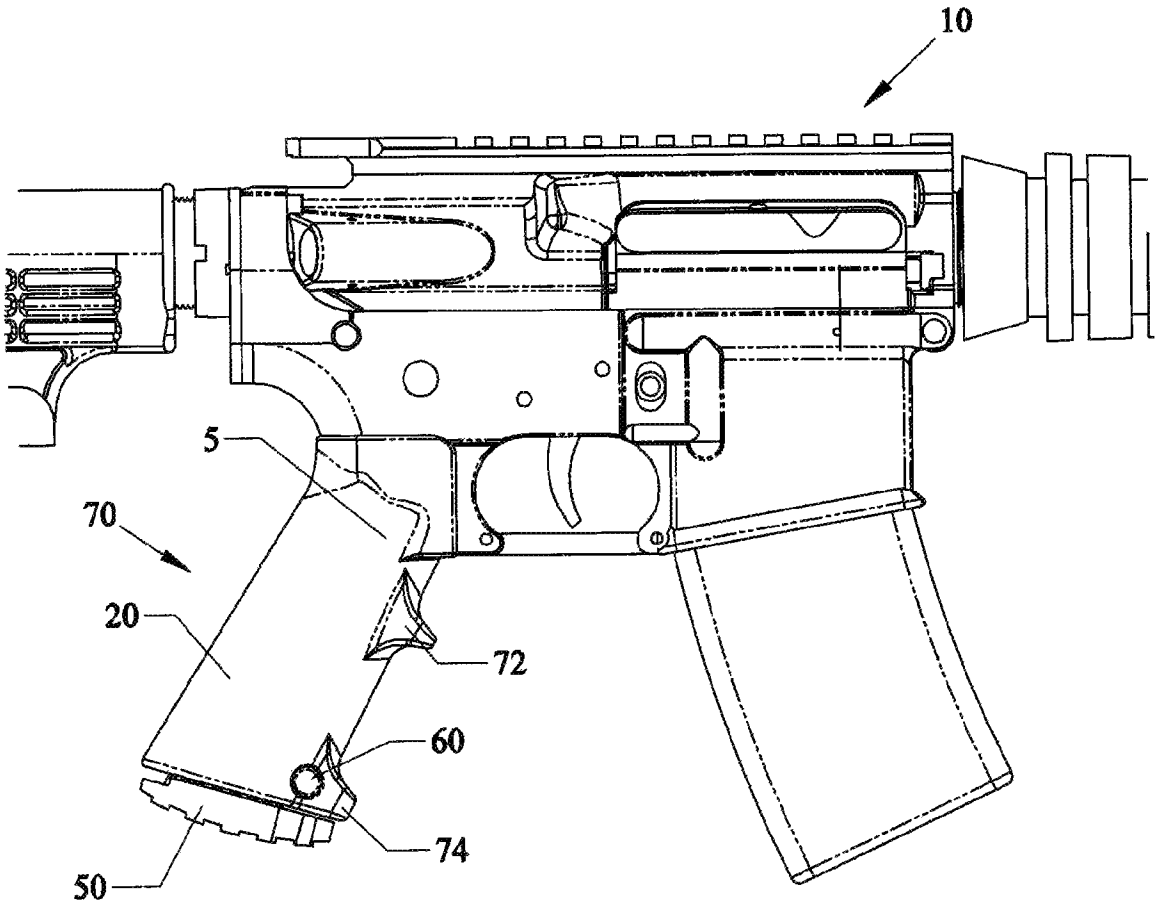
FIG. 3 is an enlarged side view of the monopod assembly on the rifle of FIG. 1 retracted.
Figure 4:
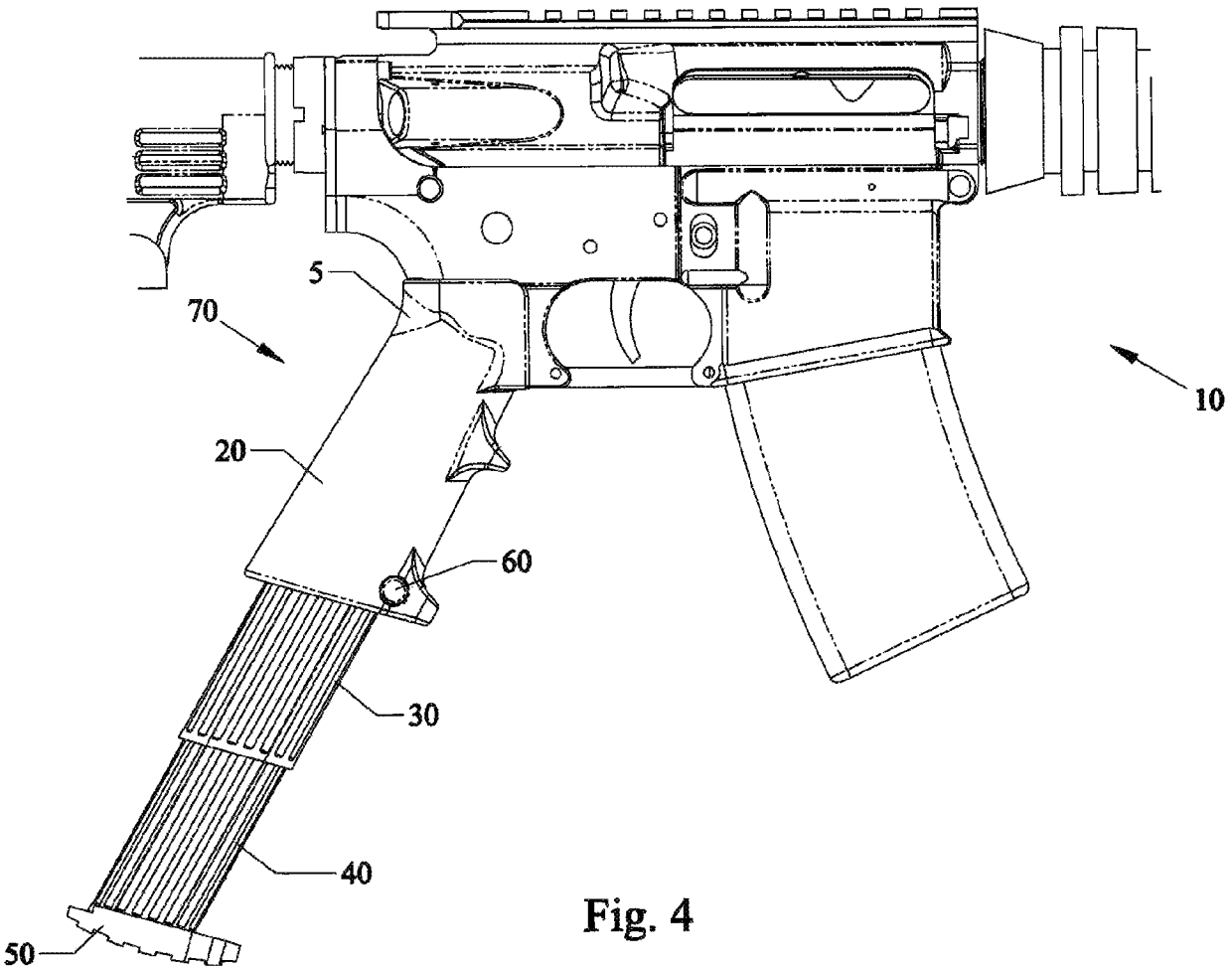
FIG. 4 is an enlarged side view of the monopod assembly on the rifle of FIG. 2 fully extended.

FIG. 1 is a perspective side view of an assault rifle 10 with an installed monopod grip assembly 20 with the monopod retracted. FIG. 2 is a perspective view of assault rifle 10 with monopod grip assembly 20 of FIG. 1 with the monopod formed by the telescoping cylinder inserts 30, 40 fully extended. The grips length can be adjusted along the length of insert #1 (upper telescoping cylinder 30). FIG. 3 is an enlarged side view of the monopod assembly 20 on the rifle 10 of FIG. 1 retracted. FIG. 4 is an enlarged side view of the monopod assembly on the rifle of FIG. 2 with the monopod formed by the telescoping cylinders 30, 40 fully extended.

Figure 6:
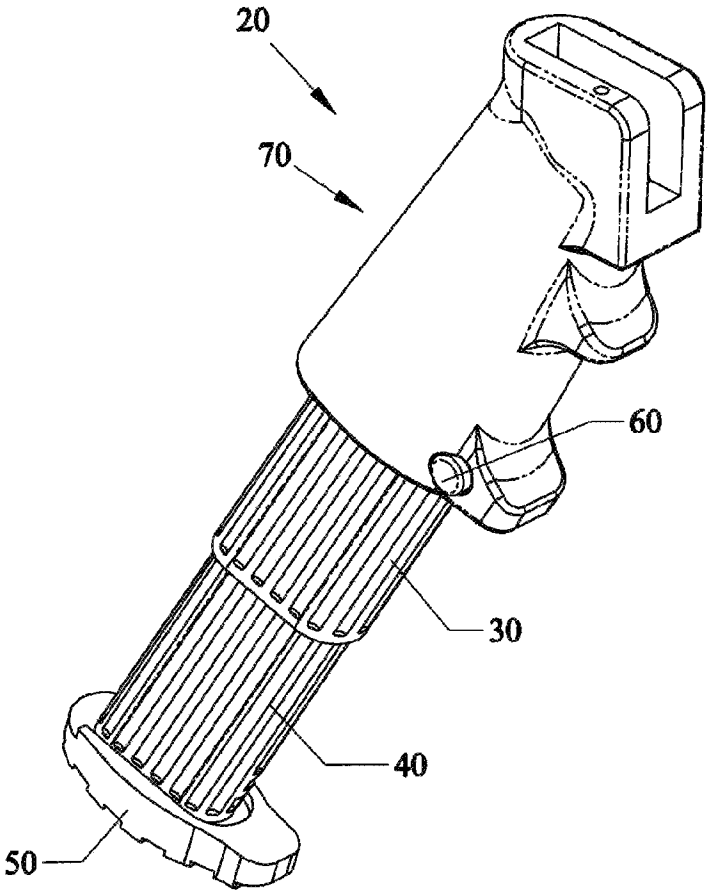
FIG. 6 is a left perspective view of the monopod assembly of FIGS. 2, 4 fully extended.
Figure 5:
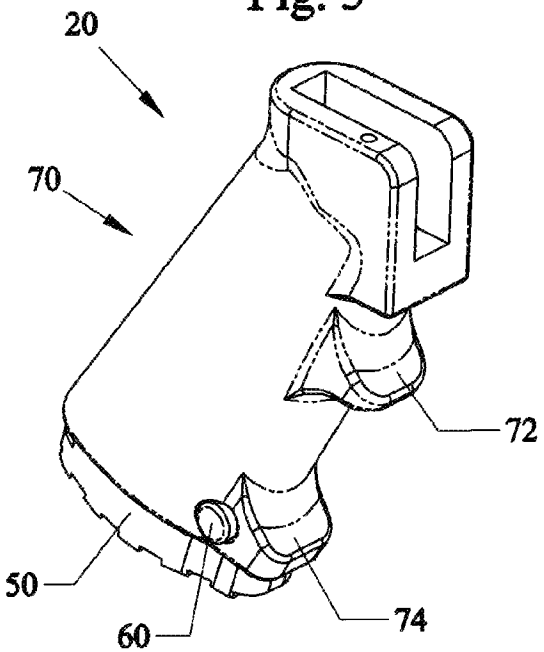
FIG. 5 is a left perspective view of the monopod assembly of FIGS. 1, 3 fully retracted.
Figure 8:
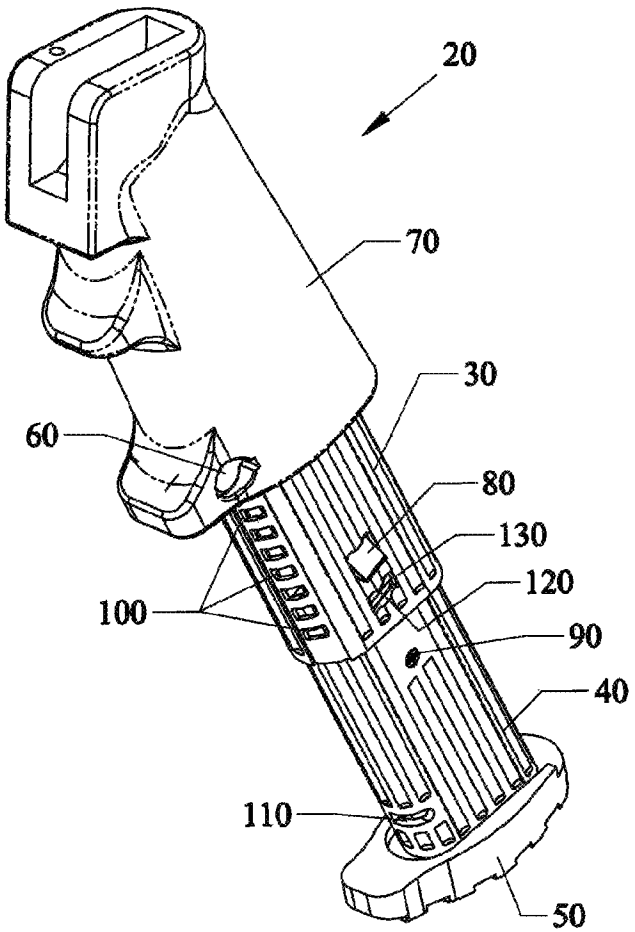
FIG. 8 is a right perspective view of the extended monopod assembly of FIG. 6.
Figure 7:
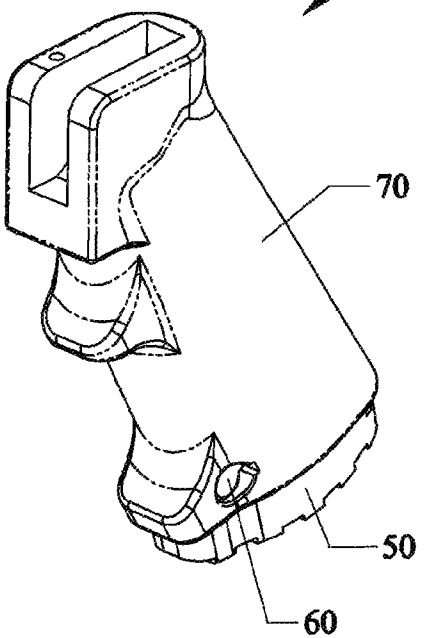
FIG. 7 is a right perspective view of the retracted monopod assembly of FIG. 5.
Figure 11:
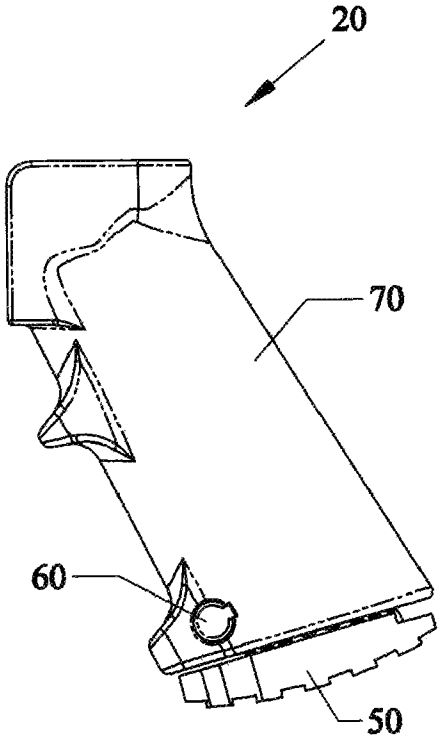
FIG. 11 is a right side view of the retracted monopod assembly of FIGS. 5, 7.
Figure 10:
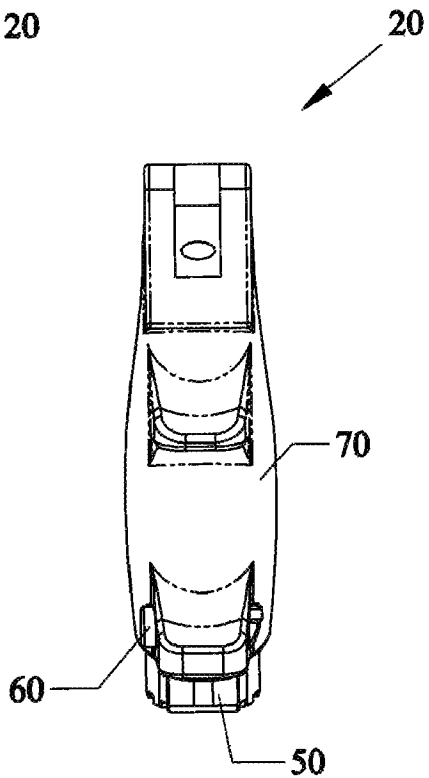
FIG. 10 is a front side view of the retracted monopod assembly of FIGS. 5, 9.
Figure 9:
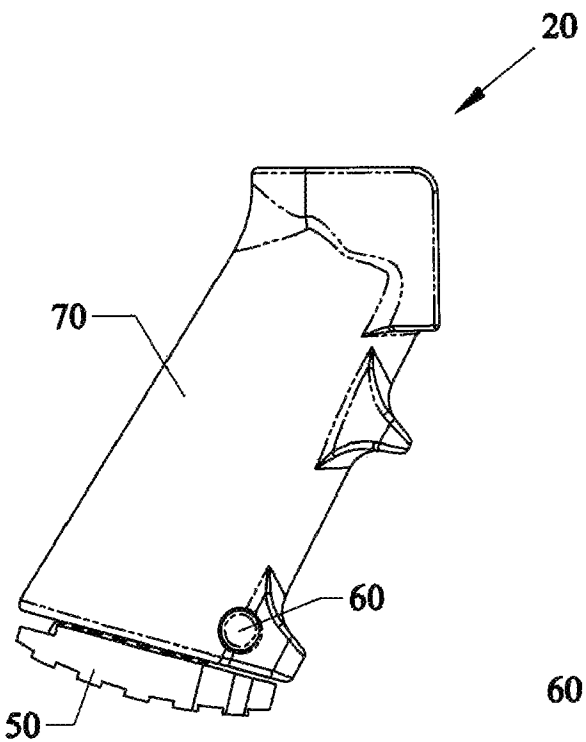
FIG. 9 is a left side view of the retracted monopod assembly of FIG. 5.
Figure 14:
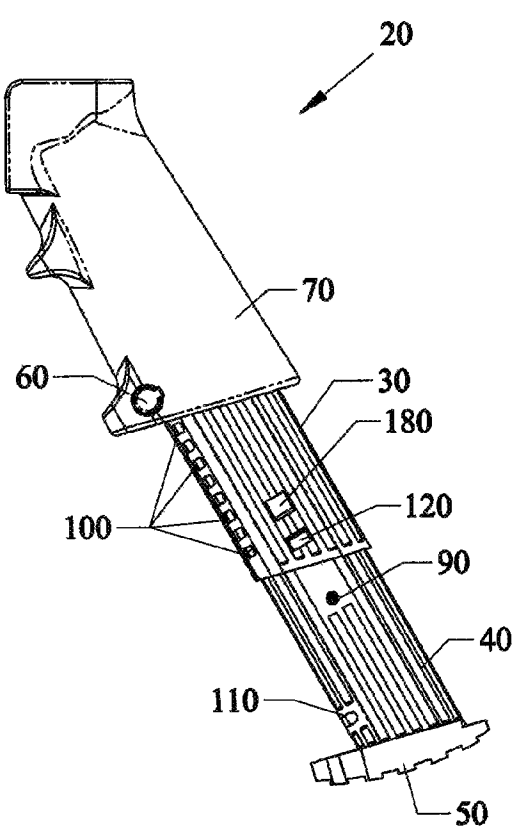
FIG. 14 is a right side view of the fully extended monopod assembly of FIGS. 6, 8.
Figure 13:
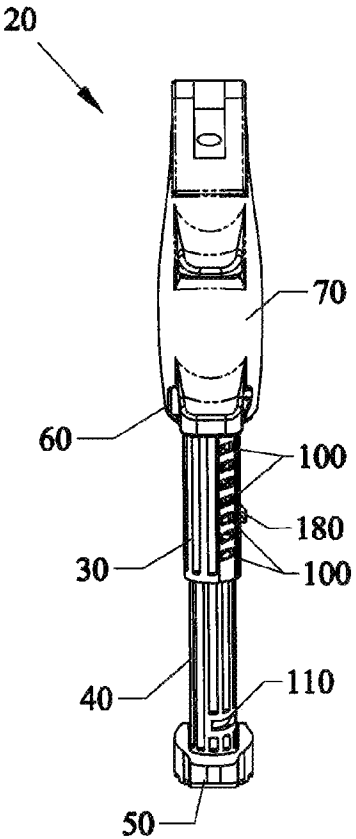
FIG. 13 is a front side view of the fully extended monopod assembly of FIGS. 6, 8.
Figure 12:
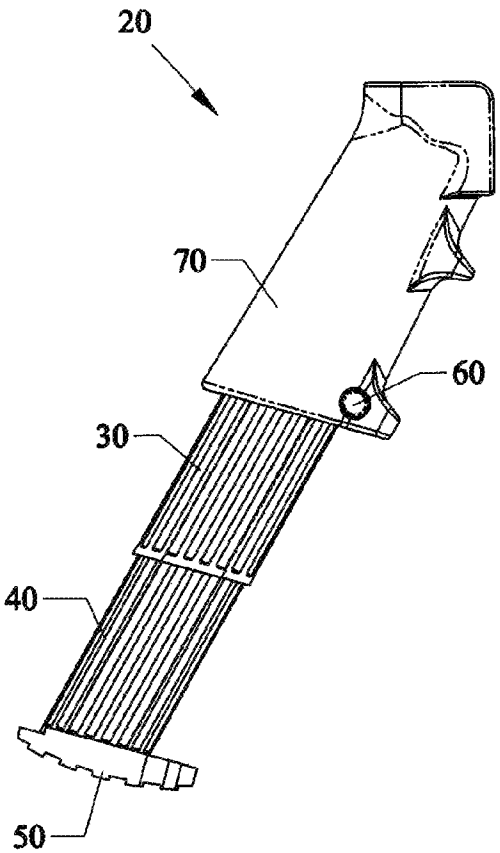
FIG. 12 is a left side view of the fully extended monopod assembly of FIG. 6.

FIG. 5 is a left perspective view of the monopod assembly 20 of FIGS. 1, 3 fully retracted. FIG. 6 is a left perspective view of the monopod assembly 20 of FIGS. 2, 4 fully extended. FIG. 7 is a right perspective view of the retracted monopod assembly 20 of FIG. 5. FIG. 8 is a right perspective view of the extended monopod assembly 20 of FIG. 6. FIG. 9 is a left side view of the retracted monopod assembly 20 of FIG. 5. FIG. 10 is a front side view of the retracted monopod assembly 20 of FIGS. 5, 9. FIG. 11 is a right side view of the retracted monopod assembly 20 of FIGS. 5, 7. FIG. 12 is a left side view of the fully extended monopod assembly 20 of FIG. 6. FIG. 13 is a front side view of the fully extended monopod assembly 20 of FIGS. 6, 8. FIG. 14 is a right side view of the fully extended monopod assembly 20 of FIGS. 6, 8.

Figure 15:
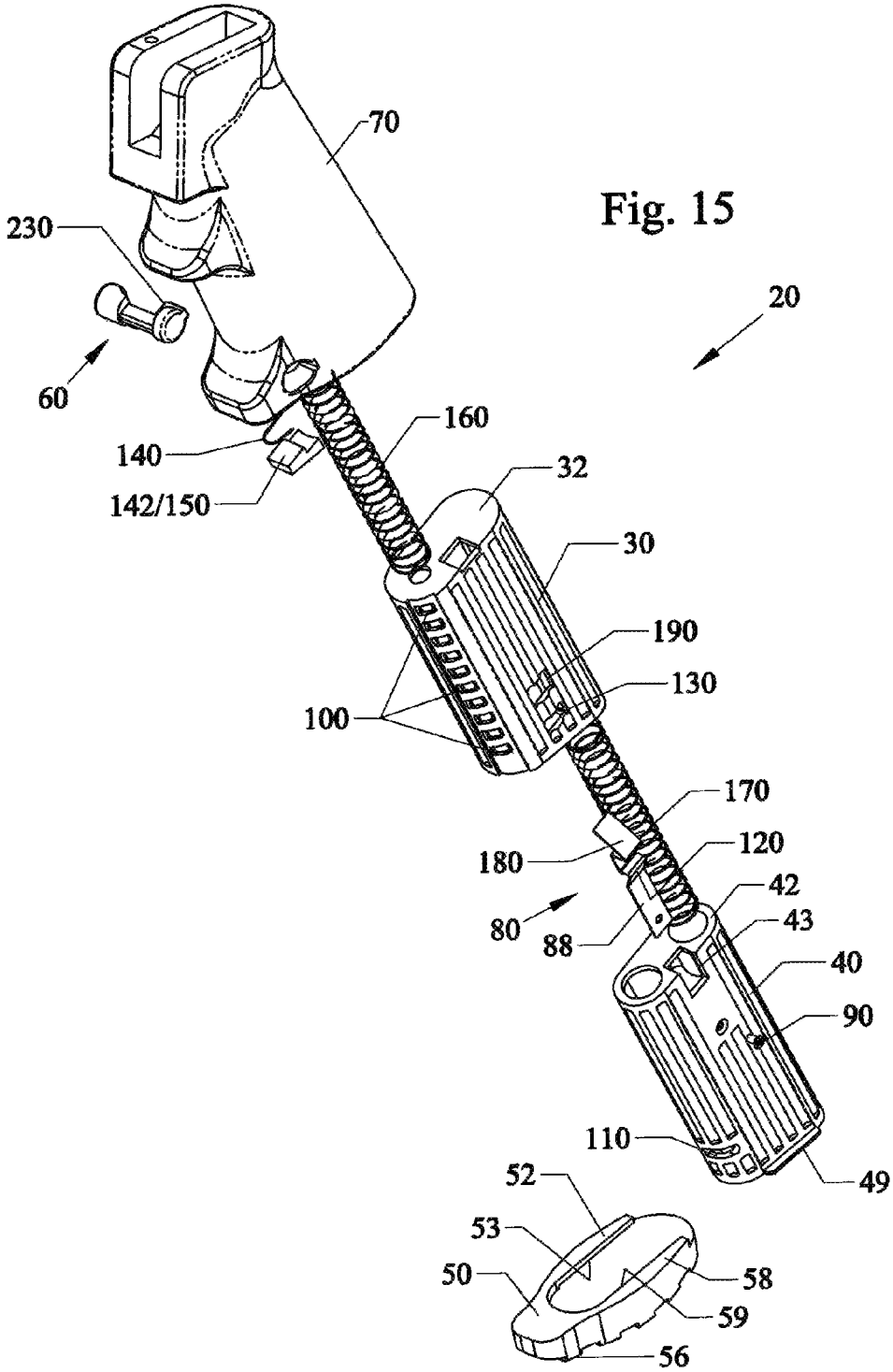
FIG. 15 is an exploded view of the monopod assembly of the preceding figures.
Figure 16:
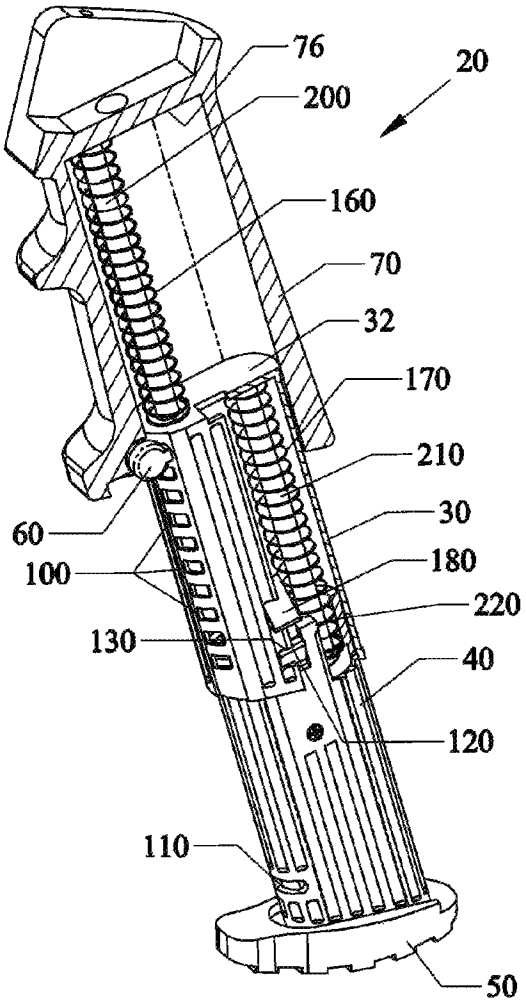
FIG. 16 is a perspective right side view of the fully extended monopod assembly of FIG. 14 with grip and upper telescoping cylinder cut-away to expose the workings of the extension springs and actuator button.

FIG. 15 is an exploded view of the monopod assembly 20 of the preceding figures. FIG. 16 is a perspective right side view of the fully extended monopod assembly 20 of FIG. 14 with grip 70 and upper telescoping cylinder 30 cut-away to expose the workings of the extension springs 160, 170 and actuator button 60.

Figure 17:
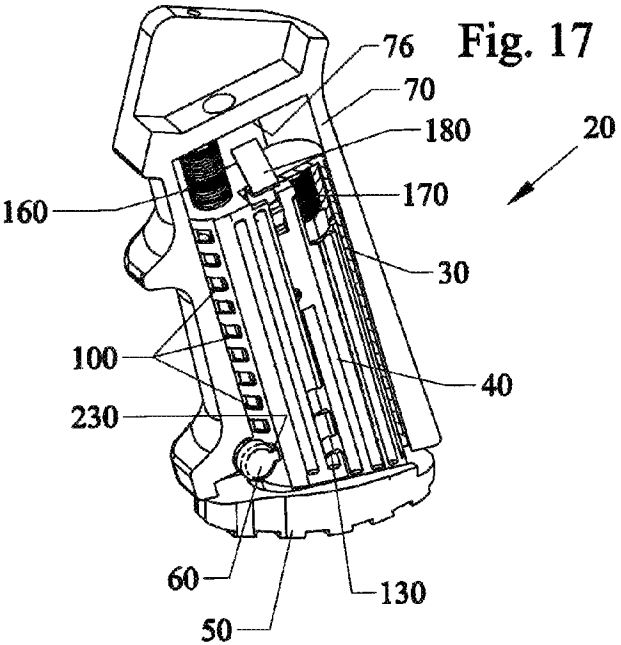
FIG. 17 is a perspective right side view of the retracted monopod assembly of FIG. 11 with grip and upper telescoping cylinder cut-away to expose the workings of the extension springs and actuator button.

FIG. 17 is a perspective right side view of the retracted monopod assembly 20 of FIG. 11 with grip 70 and upper telescoping cylinder 30 cut-away to expose the workings of the extension springs 160, 170 and actuator button 60.

Figure 18:
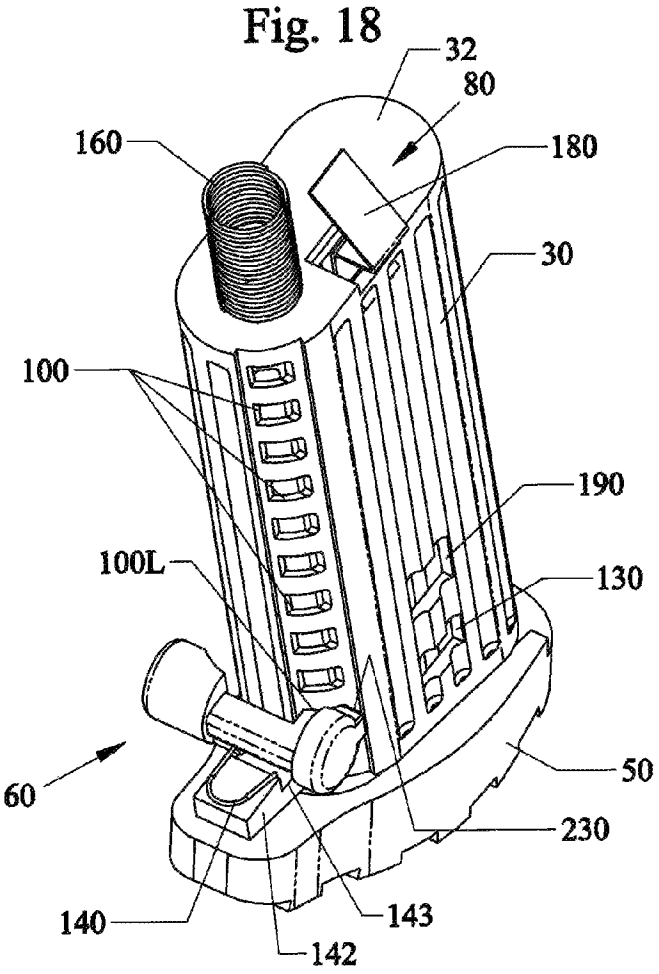
FIG. 18 is a top perspective view of the retracted monopod assembly of FIG. 17, where the grip is not shown to expose the workings of the actuator button.

FIG. 18 is a top perspective view of the retracted monopod assembly 20 of FIG. 17, where the grip 70 is not shown to expose the workings of the actuator button 60. The locking tab 142 with step 143 on the button 60 is shown engaging the lowermost slot 100L in insert #1 (upper telescoping cylinder 30, which locks the insert in it's uppermost position. The only slot in insert #2 (lower telescoping cylinder 400) (unseen, nested inside insert #1 (upper telescoping cylinder 30)) is also engaged by the locking tab 142, 143. This locks insert #2 (lower telescoping cylinder 40) in the fully retracted position. The button 60 is held in this position by the buttons return spring.

Figure 19:
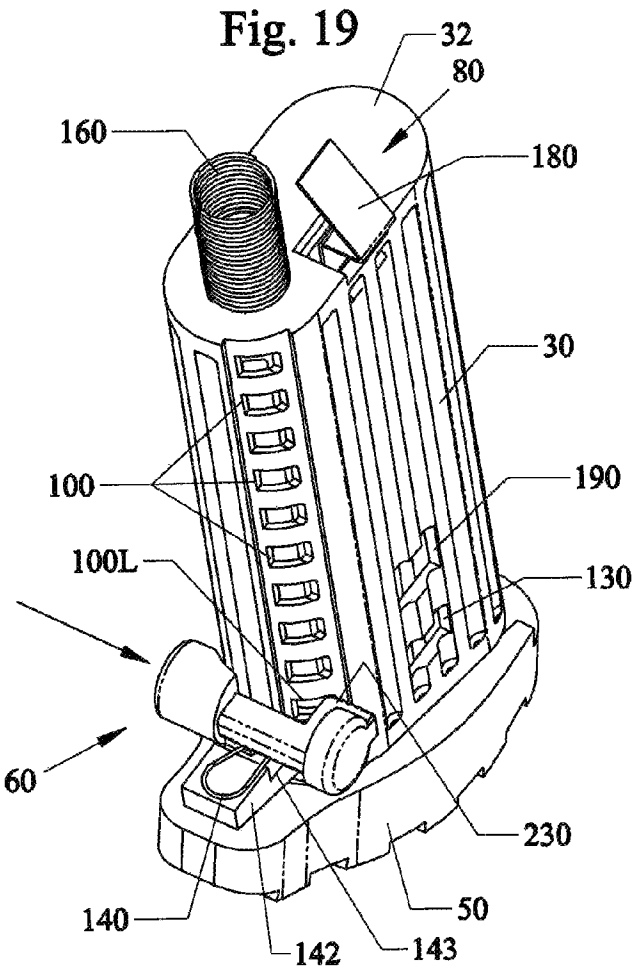
FIG. 19 is a top perspective view of retracted monopod assembly of FIG. 18.

FIG. 19 is a top perspective view of retracted monopod assembly 20 of FIG. 18. The grip 70 is not shown to expose the workings of the actuator button. The button 60 is shown pressed to the right (compressing the buttons return spring 140). This disengages the buttons locking tab 142 from the lowermost slot 100L in insert #1 (upper telescoping cylinder 30). This allows the insert #1 (upper telescoping cylinder 30) extension spring 160 to push insert #1 (upper telescoping cylinder 30) out of the grip 70. The distance that insert #1 (upper telescoping cylinder 30) is permitted to extend from the grip 70 can be controlled by releasing the actuator button 60 and allowing the buttons return spring 140 to re-engage the locking tab 142 on the button 60 with one of the multiple slots 100 cut into insert #1 (upper telescoping cylinder 30). Pushing the button 60 to the right simultaneously disengages it from the lone slot in insert #2 (lower telescoping cylinder 40). This allows insert #2 (lower telescoping cylinder 40) to fully extend and lock into the fully extended position. In the embodiment shown, insert #2 (lower telescoping cylinder 40) does not have and adjustable extension length. It is either fully retracted or fully extended. The invention can be practiced with other embodiments that allow for the lower telescoping cylinder 40 to also be adjustably extended with additional switches and the like.

Figure 20:
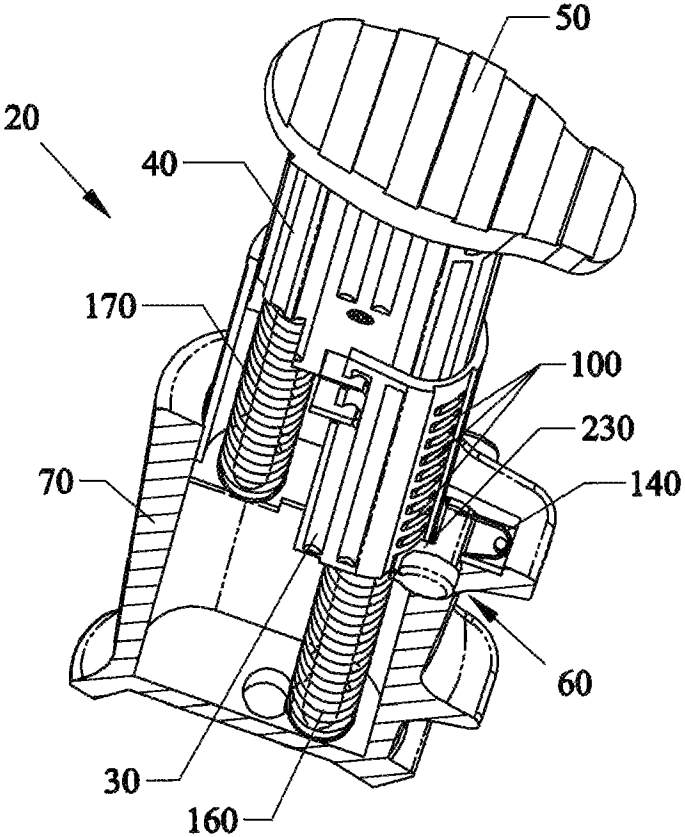
FIG. 20 is a bottom cut-away view of the retracted monopod assembly of the preceding figures intended to better show how the actuator button return spring works.

FIG. 20 is a bottom cut-away view of the retracted monopod assembly 20 of the preceding figures intended to better show how the actuator button 60 return spring 140 works. In FIG. 20, the button 60 is not pressed.

Figure 21:
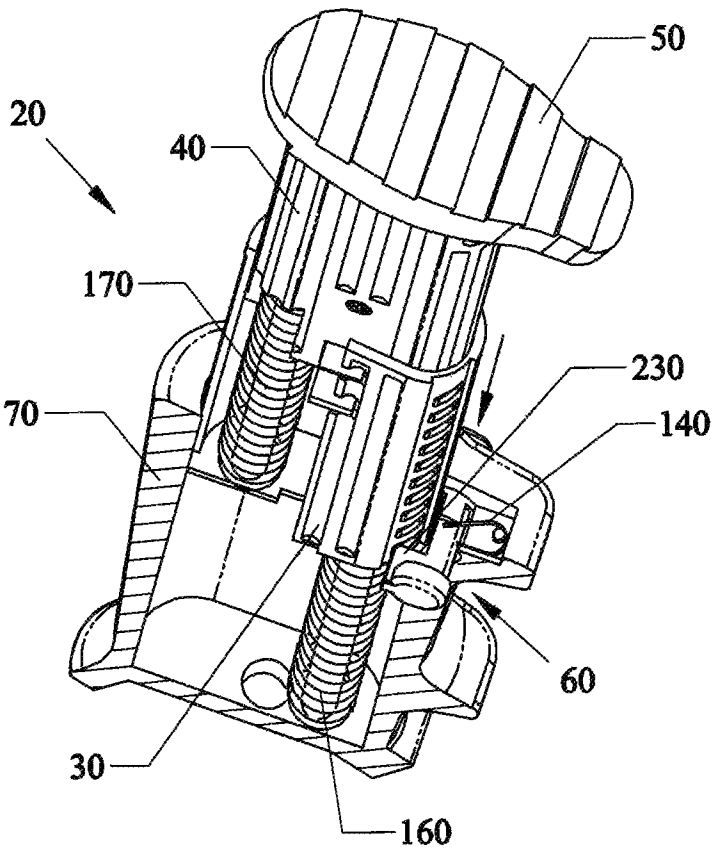
FIG. 21 is another bottom cut-away view of FIG. 20 showing the button pressed toward the bottom of the view and the return spring flexed.

FIG. 21 is another bottom cut-away view of FIG. 20 showing the button 60 pressed toward the bottom of the view and the return spring 140 flexed.

Figure 22:
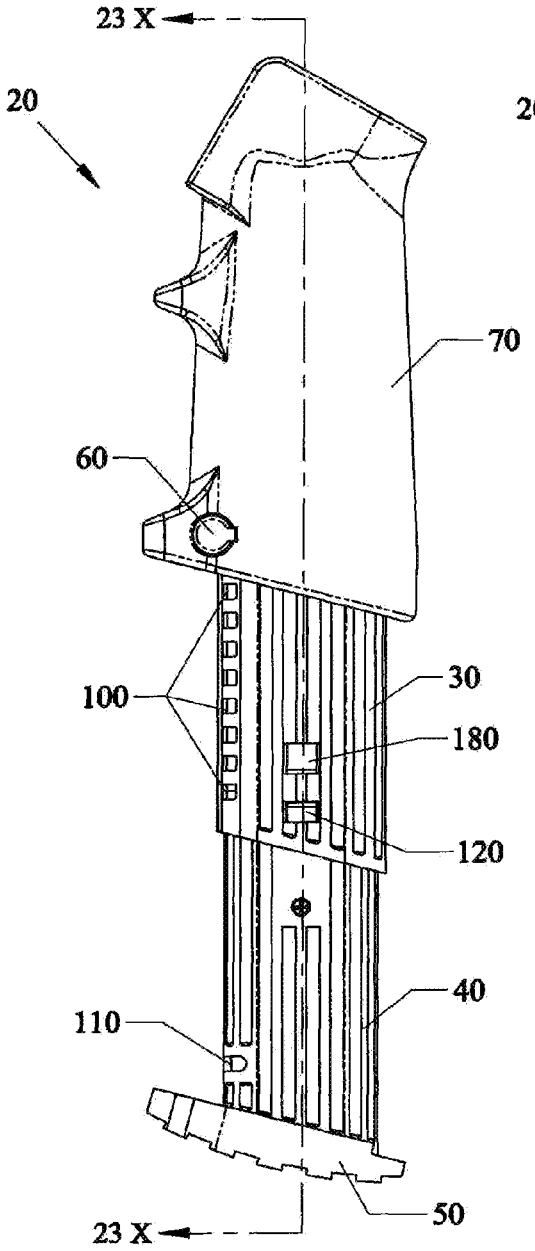
FIG. 22 is a right side view of the fully extended monopod assembly of FIGS. 8 and 14.
Figure 23:
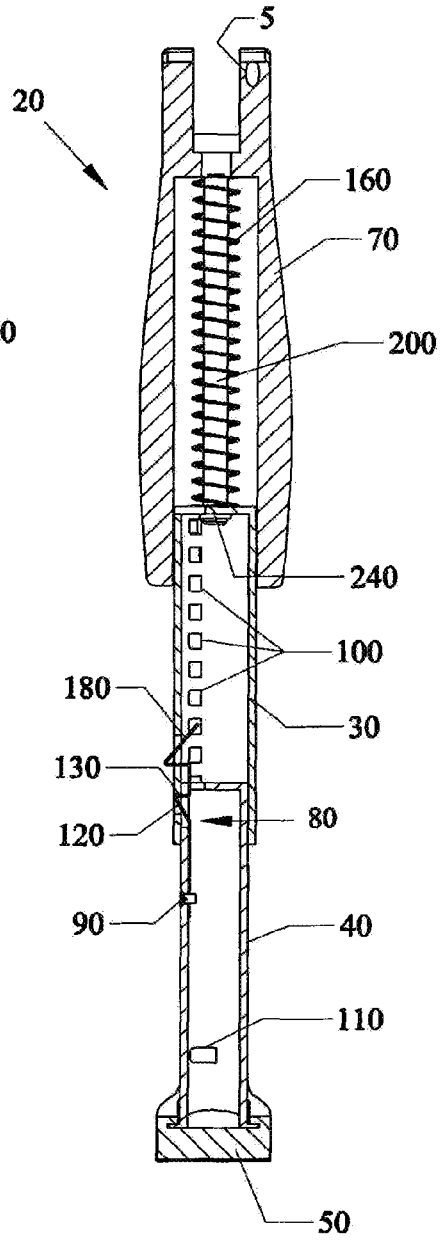
FIG. 23 is a cross-sectional view of FIG. 22 along arrows 23X showing how the upper telescoping cylinder locking spring works.

FIG. 22 is a right side view of the fully extended monopod assembly 20 of FIGS. 8 and 14. FIG. 23 is a cross-sectional view of FIG. 22 along arrows 23X showing how the upper telescoping cylinder 20 locking spring 160 works.

Referring to FIGS. 1-5 and 23, the grip assembly 20 can be located inside of a grip housing 70 and can be attached under a rear portion of the firearm type rifle by a clip 5 that can be attached to the underside of the rear of the rifle by conventional fasteners, such as bolts, screws, and the like. The grip housing 70 can have raised protrusions 72, 74, which can be used to enhance the gripping about the housing by the hand of the user.

The novel grip assembly 20 can take the place of a conventional rear pistol grip on a firearm. The novel grip assembly can include inserts 1 and 2, which correspond to upper and lower telescoping cylinders that together can form an extendable and retractable monopod, that can raise and lower the firearm type rifle over ground type surfaces. The novel grip assembly can move from retracted positions to extended positions.

A retracted position is shown by FIGS. 1, 3, 5, 7, 9-11, and 17-19, while the extended position is shown in FIGS. 2, 4, 6, 8, 12, 14, 16 and 20-23.

Referring to the retracted position of FIGS. 1, 3, 5, 7, 9-11, 15 and 17-19, inserts 1 and 2, which correspond to telescoping cylinders 30, 40 can be generally oval in shape, and can easily fit inside the handgrip 60. The cylinders 30, 40 can each be hollow and formed from aluminum, stainless steel, and the like, where their overall size allows for increased strength as compared to narrow diameter threaded bolts, and the like. Alternatively, the cylinders 30, 40 can be formed from injection molded plastic, composites, combinations thereof, and the like that can be tested to support weights of the rifle firearm, as well as enough durability to withstand extreme heat and extreme cold that can be found in field conditions from deserts to frozen terrain, and the like.

Lower telescoping cylinder 40 (insert 2) can telescope in an out of upper telescoping cylinder 30 (insert 1). Together both cylinders 30, 40 can move in and out of grip housing 70.

FIG. 17 is a perspective right side view of the retracted monopod assembly 20 of FIG. 11 with grip 70 and upper telescoping cylinder 30 cut-away to expose the workings of the extension springs 160, 170 and actuator button 60.

FIG. 18 is a top perspective view of the retracted monopod assembly 20 of FIG. 17, where the grip 70 is not shown to expose the workings of the actuator button 60. The locking tab 142 with step 143 on the button 60 is shown engaging the lowermost slot 100L in insert #1 (upper telescoping cylinder 30, which locks the insert in it's uppermost position. The only slot in insert #2 (lower telescoping cylinder 400) (unseen, nested inside insert #1 (upper telescoping cylinder 30)) is also engaged by the locking tab 142, 143. This locks insert #2 (lower telescoping cylinder 40) in the fully retracted position. The button 60 is held in this position by the buttons return spring 140.

In the retracted position the upper extension spring 160 wrapped about guide pin 200 is compressed between the bottom of upper ledge 76 inside the grip housing 70 of the grip assembly 20 and the top 32 of upper telescoping cylinder 30 (insert 1), as shown in FIGS. 15-16. Guide pin 200 can be attached or molded to extend down from the bottom 76 of the upper ledge in the grip housing 70.

Additionally, in the retracted position, telescoping insert #2 (lower cylinder 40) extension spring 170 wrapped about guide pin 210 is also in a compressed state between the inside of top 32 of the insert #1 (upper telescoping cylinder 30) and a partial cavity 220 through the top 42 of insert #2 (lower telescoping cylinder 40), as shown in FIGS. 15, 17. Guide pin 210 can be attached or molded to extend down from the inside lower surface of top 32 of insert #1 (upper cylinder 30).

The bottom 88 of locking spring 80 is fixably attached inside slot opening 43 of lower cylinder 40 and held in place by a fastener 90, which can be a mounting screw, and the lock for fixably supporting the locking spring 80 to lower cylinder 40 (insert #2).

Ramp 180 on locking spring 80 engages inside edge of monopod grip 70 when the inserts 1, 2 (telescoping cylinders 30, 40) are pushed into the grip housing 70. When the ramp 180 engages the inside edge of the grip 70 it flexes the locking spring 80 and disengages the catch 120 on the spring 80 from the slot 130 in insert #1 (30) which allows insert #2 (cylinder 40) to fully retract into insert #1 (cylinder 30). Slot 130 is cut into insert #1 (upper cylinder 30) for locking spring 80 engagement.

Slot 190 (FIGS. 18-19) is cut into upper cylinder 30 (insert #1) for the ramp 180 on the locking spring 80.

In the retracted position, the button 60 engages a single slot 110 (FIG. 15) cut into insert #2 (lower telescoping cylinder 40) when the cylinders 30, 40 are fully retracted and locks the insert #2 (lower telescoping cylinder 40) into the retracted position.

Button 60 is held in side extending position by actuator return spring 140. Tab 142 is also a cover 150 for the spring cavity in the monopod grip housing 70. Pushing the button 60 against spring 140 toward grip housing 70 disengages the locked retracted position to move toward the extended position is shown in FIGS. 2, 4, 6, 8, 12, 14, 16 and 20-23.

FIG. 19 is a top perspective view of retracted monopod assembly 20 of FIG. 18. The grip 70 is not shown to expose the workings of the actuator button. The button 60 is shown pressed to the right (compressing the buttons return spring 140). This disengages the buttons locking tab 142 from the lowermost slot 100L in insert #1 (upper telescoping cylinder 30). This allows the insert #1 (upper telescoping cylinder 30) extension spring 160 to push insert #1 (upper telescoping cylinder 30) out of the grip 70. The distance that insert #1 (upper telescoping cylinder 30) is permitted to extend from the grip 70 can be controlled by releasing the actuator button 60 and allowing the buttons return spring 140 to re-engage the locking tab 142 on the button 60 with one of the multiple slots 100 cut into insert #1 (upper telescoping cylinder 30). Pushing the button 60 to the right simultaneously disengages it from the lone slot in insert #2 (lower telescoping cylinder 40). This allows insert #2 (lower telescoping cylinder 40) to fully extend and lock into the fully extended position. In the embodiment shown, insert #2 (lower telescoping cylinder 40) does not have and adjustable extension length. It is either fully retracted or fully extended.

Figure 24:
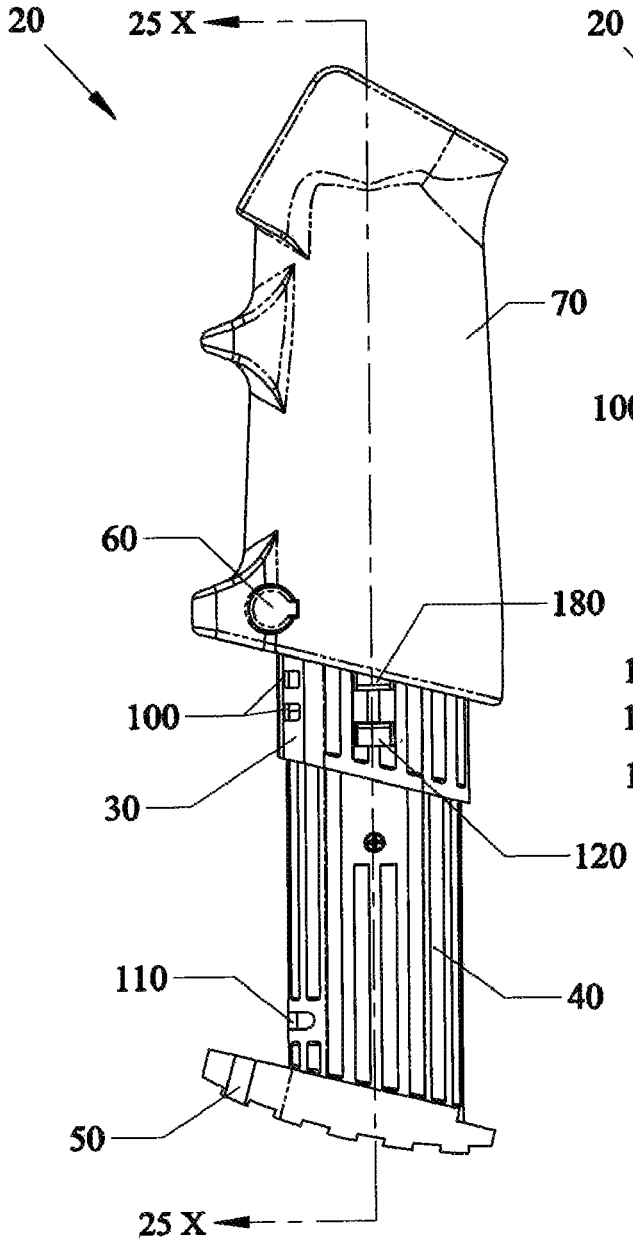
FIG. 24 is a right side view of the monopod assembly of FIG. 22 with the telescoping inserts being pushed into the grip.

Retracting the inserts #1, 2, (cylinders 30, 40) will now be described. FIG. 24 is a right side view of the monopod assembly 20 of FIG. 22 with the telescoping inserts #1, 2 (cylinders 30, 40) being pushed into the grip housing 70. The actuator button 60 must be depressed to release the buttons locking tab 230 (FIGS. 18-19) from, the slots 100 cut into insert #1 (upper cylinder 30). Insert #1 (upper cylinder 30) and insert #2 (lower cylinder 40) will remain locked together until released by the locking spring 80.

Figure 25:
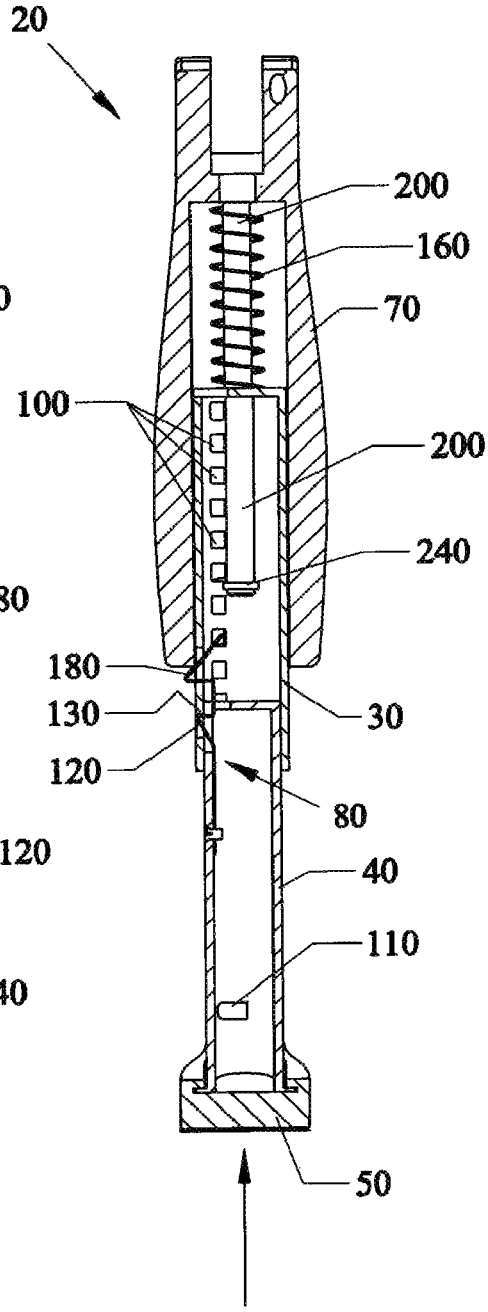
FIG. 25 is a cross-sectional view of FIG. 24 along arrows 25X.

FIG. 25 is a cross-sectional view of FIG. 24 along arrows 25X. The ramp 180 on the locking spring 80 can be seen about to engage the inside edge surface underneath of the grip 70. As it does, the spring 80 will flex toward the right, which will disengage the catch 120 on the spring 80 from the slot 130 in insert #1 (upper cylinder 30). This action unlocks insert #2 (lower cylinder 40) from insert #1 (upper cylinder 30) and allows it to be pushed into the monopod assembly 20.

Figure 26:
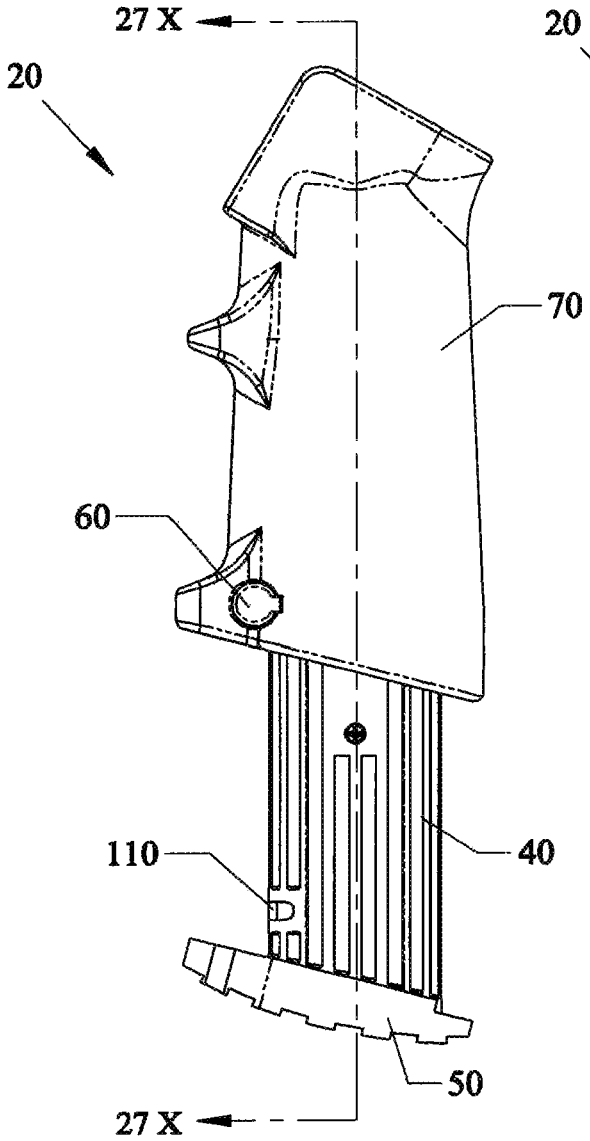
FIG. 26 is a right side view of monopod assembly of FIG. 24 with upper telescoping cylinder insert fully retracted.
Figure 27:
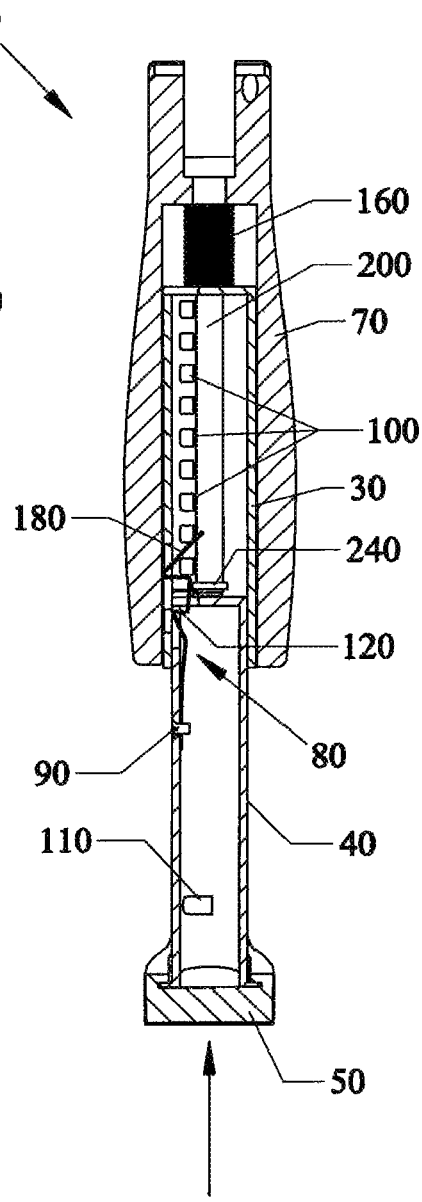
FIG. 27 is a cross-sectional view of FIG. 26 along arrows 27X.
Figure 28:
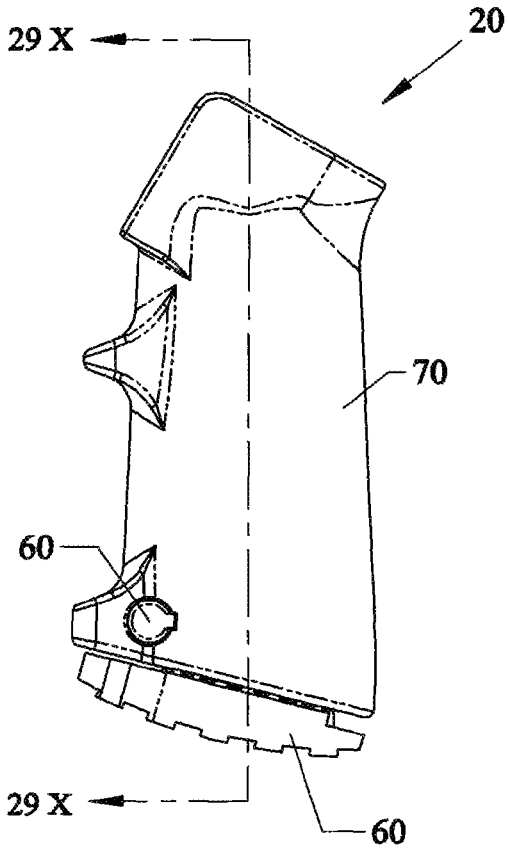
FIG. 28 is a right side view of fully retracted monopod assembly of FIG. 26.
Figure 29:
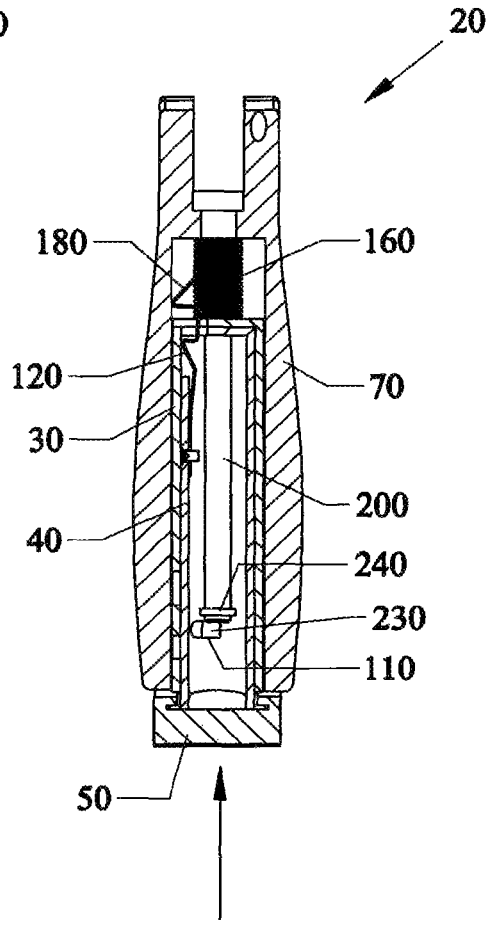
FIG. 29 is a cross-sectional view of FIG. 28 along arrows 29X.

FIG. 26 is a right side view of monopod assembly 20 of FIG. 24 with upper telescoping cylinder 30 (insert #1) insert fully retracted. FIG. 27 is a cross-sectional view of FIG. 26 along arrows 27X. The locking spring 80 can be seen flexed to the right. The catch 120 on the locking spring 80 has disengaged the slot 130 and lower telescoping insert 40 is now free to be pushed into the monopod assembly 20. FIG. 28 is a right side view of fully retracted monopod assembly 20 of FIG. 26. FIG. 29 is a cross-sectional view of FIG. 28 along arrows 29X. Both telescoping cylinder inserts #1,2 (30, 40) have been pushed into the monopod assembly 20. At this point, the locking tab 230 on the actuator button 60 has engaged the lowermost slot 100L in insert #1 (upper cylinder 30) and the only slot in insert #2 (cylinder 40). Both inserts #1, 2 (cylinders 30, 40) are now being held in the retracted position by the buttons locking tab 230 which in turn in held in the lock position by the button return spring 140.

Figure 32:
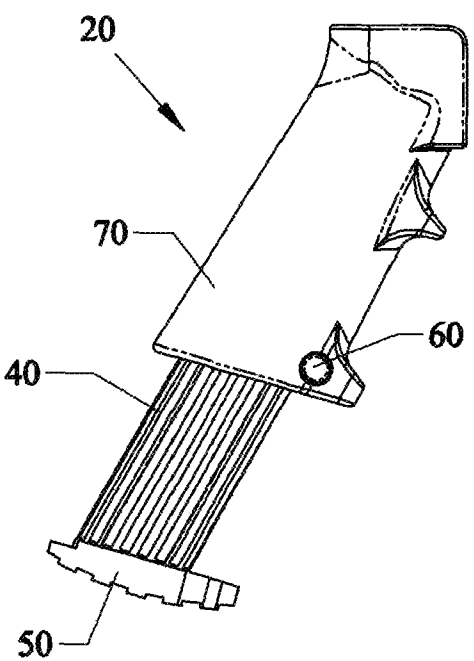
FIGS. 30, 31 and 32 are right side views of the monopod assembly of the preceding figures demonstrating the selective height adjustability of the monopod.
Figure 31:
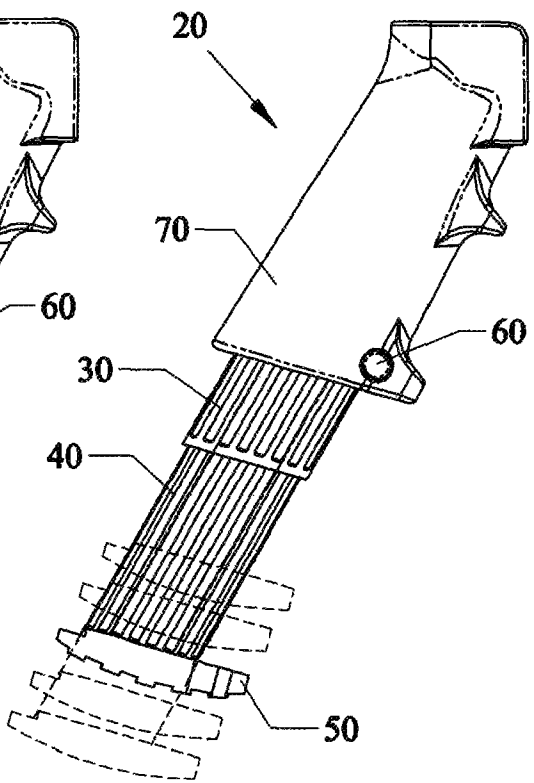
Figure 30:
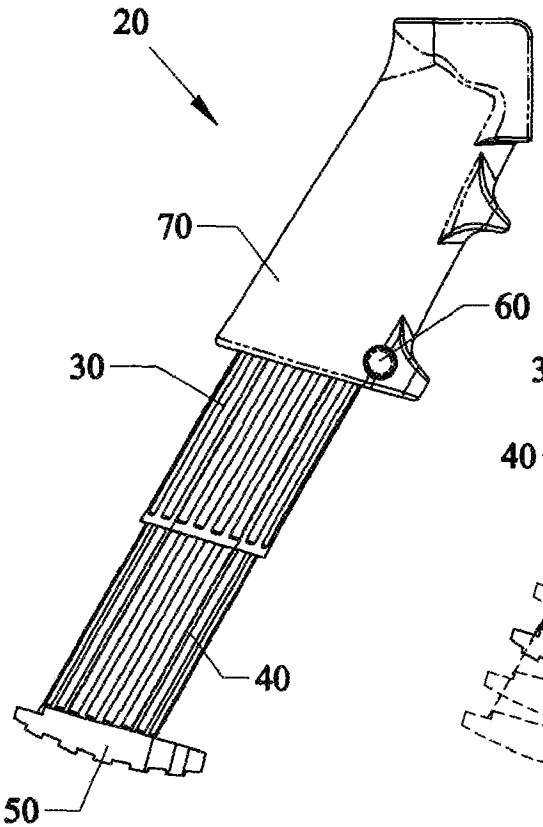

FIGS. 30, 31 and 32 are right side views of the monopod assembly 20 of the preceding figures demonstrating the selective height adjustability of the monopod. Locking tab 230 on actuator button 60 engages the slots 100 in the inserts #1, 2 to lock them into position. As described insert #1 can be locked into multiple positions to facilitate adjustment of the telescoping assembly's length. In the embodiment shown insert #2 (lower cylinder 40) can only be locked in the fully retracted position.

Snap rings 240 shown in FIGS. 25, 29 which are located on the ends of both inserts #1, 2, (cylinders 30, 40) about guide pins 200, 210 stop the motion of the inserts #1, 2 (cylinders 30, 40) when the cylinders 30, 40 are extended.

To support the novel grip assembly 20 that is inside the grip housing 70, an interchangeable foot 50 (shown more clearly in FIG. 15) having grooves 53, 59 formed between raised side edges 52, 58 forms can slide about side protruding edges 49 on the insert #2 (lower telescoping cylinder 40). The foot 50 can be sized to increase the footprint of the monopod to conform closer to the outer perimeter dimensions of the actual grip housing 70. The underside of the foot 50 can have raised edges 56 and can have a curved arc type configuration to allow the extended monopod to allow the supported rifle to rock up and down on the supported surface. The arc configuration will also allow sliding action of the supported firearm on hard surfaces. Other footers can be interchanged for different applications. For example, larger sized foots can be used for softer surfaces such as sand and the like to reduce and eliminate any sinking of the monopod. Smaller sized foots can be used to support the monopod on harder surfaces, such as rocks, compacted earth and the like.

Figure 33:
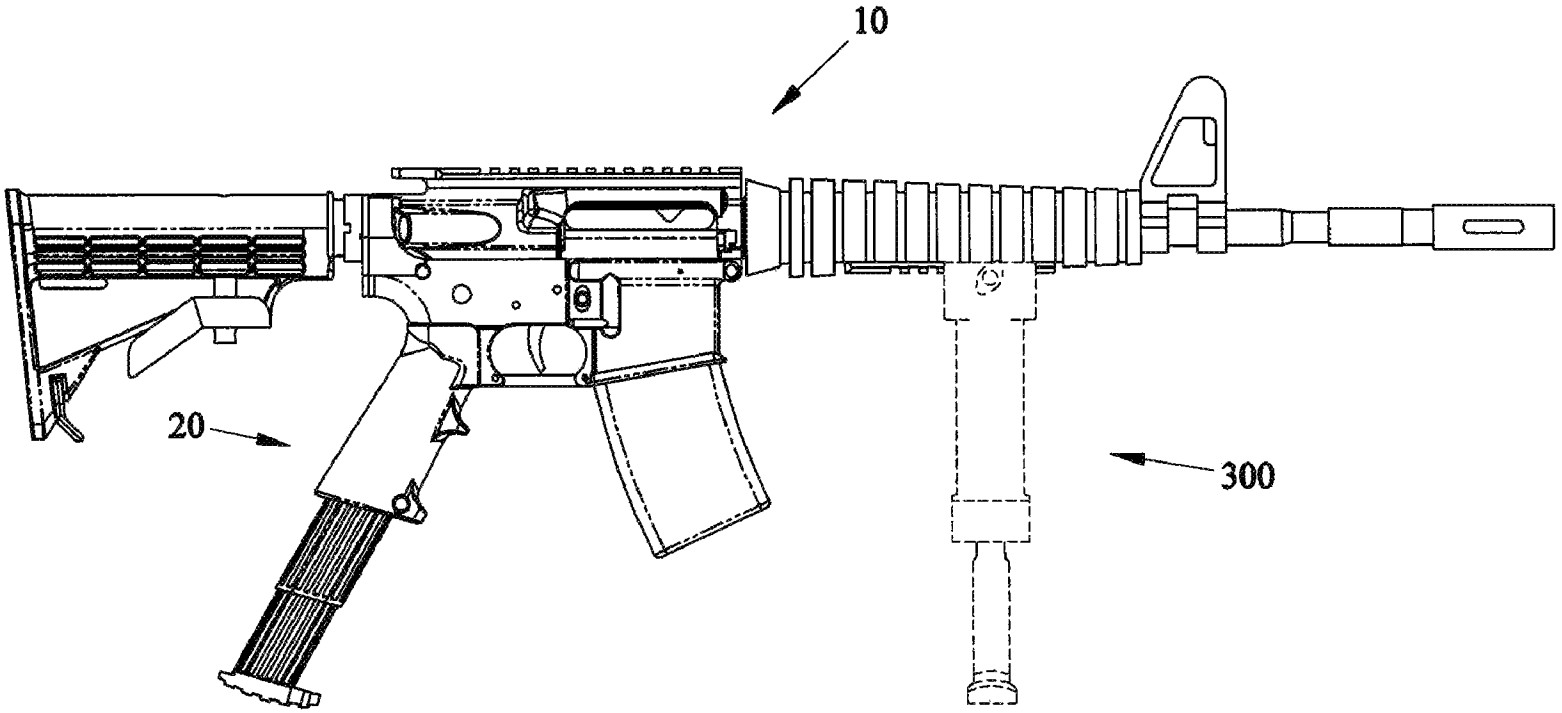
FIG. 33 shows the novel rear grip monopod assembly in an extended position on a gun with a fore grip bipod mount that allows for a triangulation support for the firearm.

FIG. 33 shows the novel rear grip monopod assembly 20 in an extended position on a gun with a fore grip bipod 300 mount that allows for a triangulation support for the firearm. The subject inventor has been a coinventor in developing forward vertical grip handles that automatically deploy bipods and which can retract back into the handle. See for example, U.S. Pat. No. 7,111,424; D566,219; D566,220; 7,409,791; 7,412,793; 7,421,815; and 7,490,429 to Moody et al. which are incorporated by reference. These novel type devices are directed to bipods on the fore grips of rifle type firearms 300 and can be used with the subject invention monopod assembly 20 to form a triangulation effect as shown in FIG. 33.

The invention can be also be used with a switch that allows the monopod to automatically retract back into the housing. Such a switch can be another spring loaded button that allows for another spring type member to automatically retract the monopod from extended positions into retracted positions inside of the housing.

The invention can also be used with a sliding switch to deploy the device. So that sliding down the side switch slides the telescoping cylinders from retracted to expanded positions under the firearm.

The sides of the telescoping cylinders can have smooth surfaces. Alternatively, the sides can have splines (longitudinal grooves) down the linear path of the cylinders to allow for small particles such as sand in order to allow the monopod device to still operate in sand or dirt environment applications.

The invention can be used with all types of hand and/or bipod operated weapons, such as but not limited to submachine guns, carbines, rifles, light machine guns and heavy machine guns, in military, and police type applications. Additionally, the invention can be used with rifles for use in civilian hunting type applications, and the like.

The invention can be practiced with other embodiments that allow for the lower telescoping cylinder 40 to also be adjustably extended with additional switches and the like.

Additionally, a slideable switch can be used on the side of the housing to retract the monopod. The switch can be slide from a lower position to a spaced apart upper position so that the monopod is retracted back into the housing. Such as sliding switch can be used without a spring.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A rear firearm grip with deployable monopod, comprising:

an elongated grip handle having an upper end and a lower end and a channel opening through the handle;

a mount member for attaching the upper end of the grip handle as a rear pistol grip on a firearm;

a telescoping assembly inside of the handle having a retracted position with the telescoping assembly within the handle, and an extended position with the telescoping assembly extended from underneath the lower end of the handle forming a monopod;

a switch on the handle for automatically moving the telescoping assembly from the retracted position to the extended position;

at least one spring member for causing the telescoping assembly to rapidly move from the retracted position to the extended position when the switch is activated; and height adjustment members in the telescoping assembly for selecting different extendable heights of the monopod, wherein the height adjustment members includes:

a vertical column of slots along a surface of a cylinder in the telescoping assembly, and a tab for locking into a selected slot which allows for the selecting of different extendable heights of the monopod, wherein the telescoping cylinder includes:

a first cylinder having the vertical row of the slots along a surface portion, a first spring for extending the first cylinder below the upper end of the handle, a second cylinder, a second spring for extending the second cylinder from below the first cylinder, and spring guide members for mounting the first spring and the second spring to be at offset axis to one another.

2. The rear firearm grip of claim 1, wherein the telescoping assembly includes:

two cylinders which slide relative to one another.

3. The rear firearm grip of claim 1, wherein the footer includes:

an interchangeable foot pad that completely covers the lower end of the grip handle.

4. The rear firearm grip of claim 1, wherein the switch includes:

a depressible button.

5. The rear firearm grip of claim 4, further comprising:

a spring for biasing the button in an extended position.

6. The rear firearm grip of claim 1, wherein the spring guide members include:

guide pins down a middle portion of the first spring and the second spring.

7. The rear firearm grip of claim 6, wherein the telescoping assembly includes:

members for preventing the first cylinder and the second cylinder from rotating relative to one another.

8. The rear firearm grip of claim 7, wherein the members include:

vertically oriented grooves along a side surface of the first cylinder and the second cylinder.

9. A method of rapidly deploying a monopod from a rear pistol grip on a firearm, comprising the steps of:

providing a rifle;

providing a rear pistol grip housing having an opening therethrough;

attaching an upper end of the rear pistol grip to the rifle;

providing a monopod having an upper end and a lower end, the monopod having a retracted position within the opening of the grip housing, and an expanded position with the lower end of the monopod extended below the grip housing;

compressing a spring with the upper end of the monopod when the monopod is in the retracted position;

releasing the spring to rapidly deploy the monopod to the extended position;

providing telescoping cylinders that slide within one another and within the grip housing;

providing a side depressible button on the housing;

rapidly and automatically expanding the telescoping cylinders from the retracted position to the extended position by actuating the depressible button; and selectively locking the telescoping cylinders to selected extended lengths with the actuating of the button, wherein the selectively locking step includes the steps of:

providing a vertical column of slots along a surface of a cylinder in the telescoping assembly, providing a tab, and inserting the tab into the slots to selectively lock the monopod to the different extendable heights;

providing a first cylinder with the vertical row of the slots along a surface portion;

extending the first cylinder below the upper end of the handle by a spring;

extending a second cylinder from below the first cylinder by a second spring; and offsetting the axis of the first spring from the axis of the second spring by different spring guide members.

10. The method of claim 9, further comprising the step of:

interchanging different sized footers on the bottom of the monopod to support the monopod over different terrain surfaces.

11. The method of claim 9, further comprising the step of preventing the first cylinder and the second cylinder from rotating relative to one another.

* * * * *